United States Patent [19]

Simon

[11] 4,254,611

[45] Mar. 10, 1981

[54] TEXTILE TWISTER MECHANISM

[75] Inventor: Albert Simon, Choisy-le-Roi, France

[73] Assignee: SKF Compagnie d'Applications Mechaniques, Clamart, France

[21] Appl. No.: 70,368

[22] Filed: Aug. 29, 1979

[30] Foreign Application Priority Data

Sep. 4, 1978 [FR] France ..... 78 25434

[51] Int. Cl.[3] ..... D01H 7/8C

[52] U.S. Cl. ..... 57/58.72; 57/58.74

[58] Field of Search ..... 57/58.49, 58.72, 58.81, 57/58.83, 58.84, 58.86

[56] References Cited

U.S. PATENT DOCUMENTS

| | | | |
|---|---|---|---|
| 2,541,541 | 2/1951 | Pellat-Finet et al. | 57/58.72 |
| 2,587,758 | 3/1952 | Pellat-Finet et al. | 57/58.72 |
| 2,873,570 | 2/1959 | Sage | 57/58.72 |
| 3,296,787 | 1/1967 | Maurin | 57/58.72 X |
| 3,546,871 | 12/1970 | Ratti | 57/58.74 X |
| 4,137,702 | 2/1979 | Monville et al. | 57/58.74 |
| 4,158,282 | 6/1979 | Guerton et al. | 57/58.72 |
| 4,167,094 | 9/1979 | Verdollin | 57/58.72 |

*Primary Examiner*—John Petrakes

*Attorney, Agent, or Firm*—Beveridge, De Grandi, Kline & Lunsford

[57] ABSTRACT

The spool carrier of a double twist textile twister is held in space by connecting it to two rotatable assemblies which rotate respectively about a centered axis and an oblique axis. The obliquely oriented assembly is connected to the spool carrier by means of bearings in a bearing housing, the exterior surface of which has two oppositely facing, transversely oriented convex cylindrical surfaces. A base on the spool carrier has depending portions with planar interior faces which engage the convex cylindrical surfaces with a minimum of play.

3 Claims, 3 Drawing Figures

TEXTILE TWISTER MECHANISM

BACKGROUND OF THE INVENTION

The invention is concerned with double-twist twister mechanisms, and it is applicable to twisters of the type disclosed in U.S. Pat. No. 4,158,282, issued June 19, 1979, to Jean-Paul Guertin et al.

This type of mechanism has a rotatable centered assembly which includes the rotating spindle, and a rotatable oblique assembly which rotates about an axis which is oblique to the rotational axis of the centered assembly. The opposite ends of the oblique assembly are rotatable, respectively, in the stationary main frame and in a spool carrier. The spool carrier is also rotatably connected to one end of the centered assembly, thereby immobilizing the spool carrier in space. The two assemblies overlap each other in the sense that each of them has at least one part crossing the other. They are coupled to each other by appropriate means, a suitable flexible coupling for this purpose being described in French Pat. No. 78 11 428, corresponding to U.S. Pat. No. 4,209,967, and which is incorporated herein by reference.

In such mechanisms, the connection of the oblique assembly to the spool carrier is quite important and critical, as the rotational axis of the oblique assembly where it connects to the spool carrier must be situated precisely in axial alignment with the rotational axis of the oblique assembly in the fixed frame. Such alignment is difficult to attain due to the accumulation of numerous tolerances involved in the installation process. One solution to this problem, described in the French Certificate of Addition 78 04 321 which corresponds to U.S. Pat. No. 4,158,282, is to enable the end of the centered assembly to slide in a ball-and-socket joint. A support is radially displaceable and can be fixed to the spool carrier after the mechanism is installed and functioning at a moderate speed. This permits self-alignment of the various parts, which thus makes it possible to take up the play of the various tolerances. Nevertheless, the assembling of these various pieces with narrow tolerances is a relatively slow and delicate process, as is the adjustment which has just been described. Furthermore, when deformation of the pieces occurs as a result of shocks, expansion or normal wear, it becomes necessary to carry out another such systematic adjustment.

The purpose of the present invention is to eliminate the preceding disadvantages by providing a structure which permits the oblique assembly to be connected to the spool carrier with a reduced number of pieces which are easy to install and which automatically effect a permanent self-alignment without undue vibrations at normal operating speeds.

SUMMARY OF THE INVENTION

According to the invention, one end of the oblique rotating assembly is connected by bearings to a bearing housing which lies between two depending portions of the spool carrier base piece. The exterior of the bearing housing includes two oppositely facing convex cylindrical surfaces which are transversely oriented relative to the rotational axis of the oblique assembly. The interior faces of the depending portions of the spool carrier base are planar so as to contact the convex cylindrical surfaces of the housing with a minimum of play. This provides the relative freedom of movement needed for assembling the apparatus, with fewer and less complicated parts. It also provides self-alignment of the parts and reduces the likelihood of any vibration-producing imbalance in the mechanism.

Other characteristics of the invention will appear from the following description of one embodiment which has been taken as an example and is represented in the annexed drawings.

DESCRIPTION OF A PREFERRED EMBODIMENT

Figure 1:
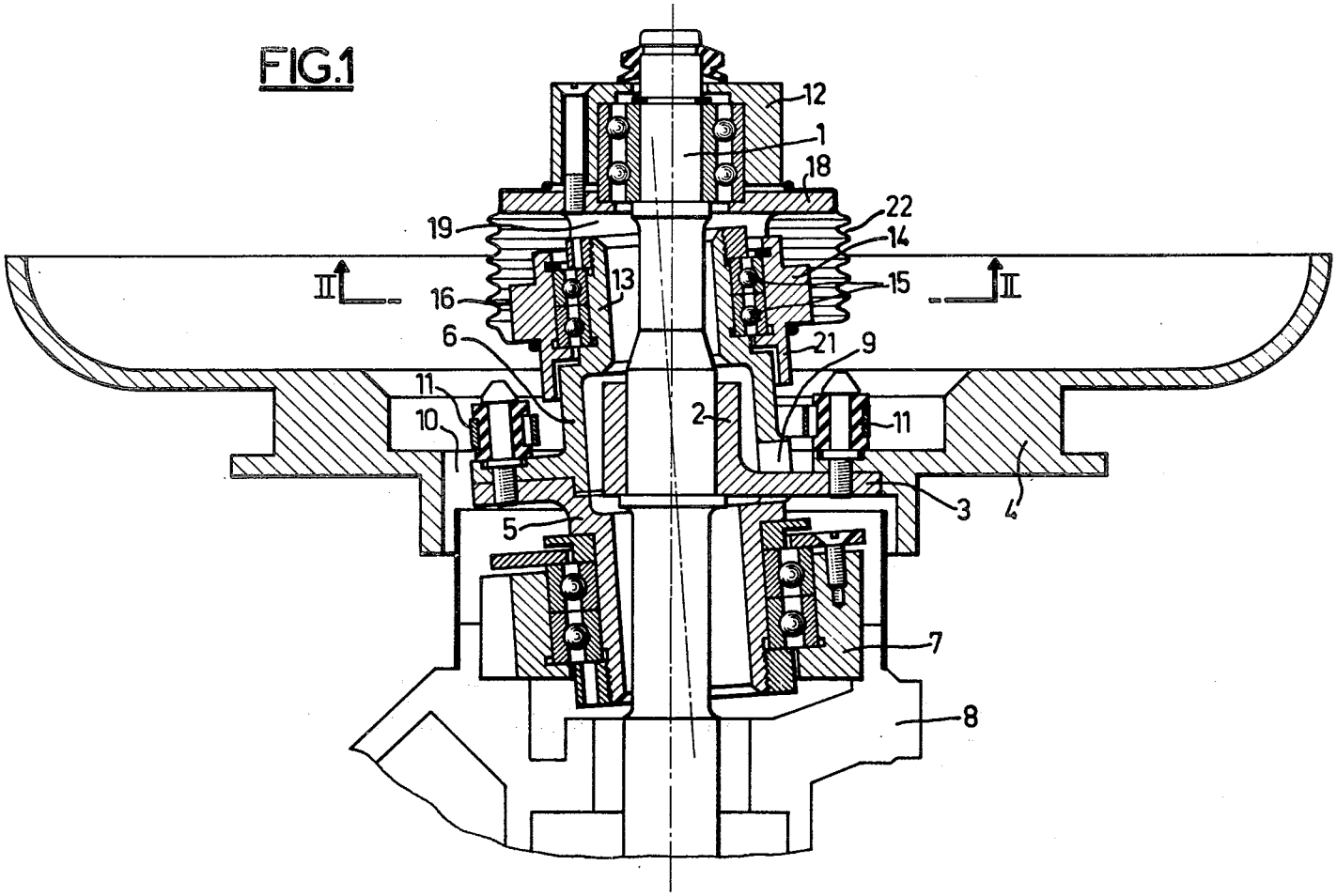
FIG. 1 is an axial cross section of the entire mechanism.

FIG. 1 shows a centered rotatable assembly which includes the main spindle 1, a hub 2 with arms 3, and a platform 4 which supports the radial yarn guide and serves to shape the balloon. A non-rotating spool carrier 12 is rotatably connected to the free end of the spindle 1.

An oblique rotatable assembly is formed of two sleeves 5 and 6 and is rotatably supported at its lower end by the oblique, fixed bearing 7 which is affixed to the frame 8. This oblique rotatable assembly has radial openings 9 through which the arms 3 of the centered assembly project. The centered assembly has axial opening 10 to enable the passage therethrough of the parts of the oblique assembly which are between the openings 9. Accordingly, the centered and oblique assemblies are mutually overlapping since each of them has parts which are interiorly of and exteriorly of the other assembly.

The two assemblies are also connected together by an appropriate coupling device, a flexible one for example, which may be situated around the intersection of the rotational axes of the two assemblies. This coupling device may be in the form of straps or webbing 11 as described in U.S. Pat. No. 4,158,282 which is incorporated herein by reference.

Since the purpose of this mechanism is to immobilize the spool carrier 12 in space, it is of course necessary to make the upper end 13 of the oblique assembly rotate relatively to the spool carrier 12, while conforming to the relative radial, axial and angular positions of these parts 12 and 13, each of which is dependent upon a large number of tolerances.

Figure 3:
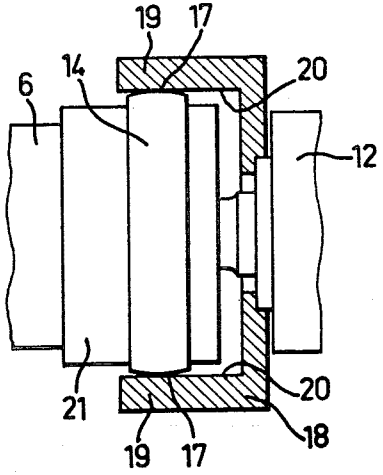
FIG. 3 is an axial, partial cross section along the line III—III of FIG. 2.

In accordance with the invention, the end 13 of the oblique assembly rotates on the inside of a housing 14 in a simple manner, without axial displacement or ball-and-socket joint articulation, by means of double ball bearings 15 held in place by a conventional axial bearing retainer. The housing 14 is a tiltable piece whose peripheral circumference 16 has opposed edge portions 17 which are convex and cylindrical. As seen in FIG. 3, each of these convex surfaces 17 is a cylindrical surface generated about an axis which is transverse to the rotational axis of the oblique assembly.

The spool carrier base 18 has a cylindrical periphery and a pair of diametrically-opposed depending portions 19. The latter are provided with opposed inner faces 20 which are planar and mutually parallel. The distance between these faces makes it possible to install therebetween, with very small clearances, the housing 14 with its convex surfaces 17. The radius of curvature of surfaces 17 is no greater than half the distance between these surfaces 17. The radius of curvature is at most equal to and preferably is less than half this distance between surfaces 17.

Figure 2:
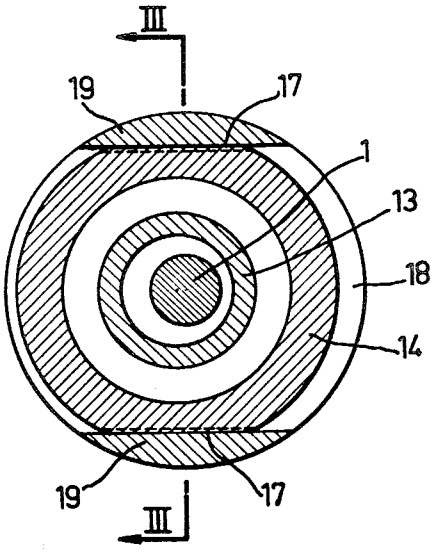
FIG. 2 is a transverse cross section along the line II—II of FIG. 1.

The convex shape of surfaces 17 makes it possible to insert the housing 14 into the space between portions 19 of the spool carrier base 18 easily by allowing an inclined presentation in the plane of FIG. 3. Also, the structure makes it possible to incline the spool carrier base 18 relative to the housing 14 in the plane of FIG. 1. Vertical and horizontal relative movement between members 14 and 18 is also possible, since these movements take place in the plane of FIG. 1, parallel to the planar faces 20 shown in FIG. 2.

The entire mechanism may be protected against dust and textile fibers, by providing the housing 14 with a lower skirt 21 and enclosing the space around the upper end of housing 14 with a shield such as a flexible bellows 22. This bellows extends between the base of the housing 14 and the base 18 of the cap to close up the entire mechanism while permitting all of the relative movements described above.

The disclosed structure provides the above-mentioned three freedoms of movement between the two pieces 14 and 18, without the intermediate pieces of the prior art. The pieces of the apparatus are less numerous and their shapes are less complicated. The self-alignment is obtained by elements which do not rotate with the centered and oblique assemblies, so they do not require balancing and do not introduce any vibration, even at the highest rate of speed. In fact, the pieces 14 and 18 are in perfect equilibrium. Although both of them are installed offcenter, they are centered during their manufacture, and they retain their self-alignment capability at all times. Also, the final mounting of the spool carrier 12 and its base 18 is accomplished without any difficulty by fitting it axially onto the spindle 1 without concern for the inclination of the sleeve 13 and its housing 14. The bellows 22 is preconnected to one of the pieces, and is finally connected to the second piece.

Persons familiar with the field of this invention will realize that its advantageous effects may be realized by many structures which differ from the disclosed preferred embodiment. In view of this, it is emphasized that the invention is not limited to the disclosed structure but is embracing of a wide variety of devices which fall within the spirit of the following claims.

I claim:

1. A double-twist twister mechanism comprising a centered rotatable assembly and an oblique rotatable assembly which overlap each other and are connected together by a coupling for concurrent rotation, a spool carrier rotatably connected to both of said rotatable assemblies, said oblique assembly being connected to the spool carrier by means which includes a bearing housing and bearings which support one end of the oblique assembly for rotation in the bearing housing, said housing having an exterior surface with two oppositely facing convex cylindrical surfaces which are transversely oriented relative to the rotational axis of the oblique assembly, said spool carrier including a base piece with two opposite depending portions which have parallel planar internal surfaces spaced apart to contact the convex surfaces of the housing with a minimum of play.

2. The mechanism of claim 1 wherein said cylindrical surfaces have a radius of curvature no greater than half of the distance between said cylindrical surfaces.

3. The mechanism of claim 1 or claim 2 wherein the housing, its bearings and the depending portions of the spool carrier base piece are protected against dust by a flexible bellows which is connected to both the base piece and the housing, said housing having a depending skirt forming a shield with the oblique assembly.

* * * * *